US006472988B1

(12) United States Patent
Feld et al.

(10) Patent No.: US 6,472,988 B1
(45) Date of Patent: Oct. 29, 2002

(54) SYSTEM FOR MONITORING WEARERS OF PROTECTIVE RESPIRATORY EQUIPMENT

(75) Inventors: Sven Feld, Nalbach; Christian Giudici, Voelklingen; Thorsten Kiesewalter, Saarlouis, all of (DE)

(73) Assignee: Deutsche Telekom AG, Bonn (DE)

( * ) Notice: Subject to any disclaimer, the term of this patent is extended or adjusted under 35 U.S.C. 154(b) by 0 days.

(21) Appl. No.: 09/700,894

(22) PCT Filed: Apr. 16, 1999

(86) PCT No.: PCT/EP99/02573

§ 371 (c)(1),
(2), (4) Date: Feb. 22, 2001

(87) PCT Pub. No.: WO99/59676

PCT Pub. Date: Nov. 25, 1999

(30) Foreign Application Priority Data

May 19, 1998 (DE) ..... 198 22 412

(51) Int. Cl.[7] ..... G08B 23/00

(52) U.S. Cl. ..... 340/573.1; 340/539; 340/573.7; 600/534

(58) Field of Search ..... 340/573.1, 573.4, 340/10.1, 3.1, 3.4, 539, 573.7; 600/301, 386, 388, 389, 384, 508, 534; 128/204.21, 204.23, 204.24, 204.26

(56) References Cited

U.S. PATENT DOCUMENTS 5,277,194 A * 1/1994 Hosterman et al. ..... 600/534
5,564,429 A * 10/1996 Bornn et al. ..... 600/508
5,990,793 A * 11/1999 Bieback ..... 340/573.1
6,047,203 A * 4/2000 Sackner et al. ..... 600/508
6,198,394 B1 * 3/2001 Jacobsen et al. ..... 340/573.1

* cited by examiner

*Primary Examiner*—Van Trieu
(74) *Attorney, Agent, or Firm*—Kenyon & Kenyon

(57) ABSTRACT

A monitoring system for monitoring wearers of respiratory equipment and a mobile part and to a base station for use in such a system. To reduce the risks for wearers of respiratory equipment, system data are continuously transmitted to a base station by a mobile part which is attached to a compressed-air breathing apparatus and which has a radio transmitter. Alarm and warning signals are visually and/or audibly communicated both to the wearer of the respiratory equipment and to a monitoring person as a function of the system data.

23 Claims, 3 Drawing Sheets

SYSTEM FOR MONITORING WEARERS OF PROTECTIVE RESPIRATORY EQUIPMENT

CROSS-REFERENCE(S) TO RELATED APPLICATION(S)

The present application is the U.S. national stage application, under 35 U.S.C. § 371, of PCT Application No. PCT/EP99/02573, having an international filing date of Apr. 16, 1999.

FIELD OF THE INVENTION

The present invention relates to a monitoring system for monitoring wearers of respiratory equipment, and to a mobile part and to a base station for use in such a system.

RELATED TECHNOLOGY

Fire departments employ respiratory equipment, so-called compressed-air breathing apparatuses, which are independent of ambient air conditions. Such apparatuses enable fire fighters to still carry on their work in rooms which are completely smoke-filled. The breathing air required for this is carried on the back in one or two steel or composite-material cylinders. The operating pressure of such cylinders is 200 or 300 bar depending on type, with a cylinder capacity of 4 and 6 liters, respectively, of compressed air. Use is made, for example, of a Dräger PA94+ compressed-air breathing apparatus with two 4-liter, 200 bar steel cylinders. In this case, the air supply is 1600 liters, which is sufficient for a mission, or use, duration of approx. 20 minutes in the case of medium-heavy work. Normally, the mission time of the personnel, who act exclusively as a team, is monitored by a fireman who makes a note of the starting time of the mission. If, after a certain length of time, there has been no communication from a team, then action can be taken and rescue measures initiated. However, such a manual procedure involves some inherent risks, because the monitoring fireman must calculate for all personnel the remaining mission time, which may vary because of different starting times. Furthermore, it is difficult to locate a fireman who is in distress if he is unable to trigger an alarm.

The German Patent Document No. DE 197 42 758 describes a monitoring device for monitoring persons carrying out time-limited activities. The monitoring device has a time-measuring device which can be triggered by the very person who is to be monitored. An alarm apparatus implemented in the monitoring device is activated when a preset time has elapsed since the triggering of the time-measuring device, A similar microprocessor-controlled monitoring system for time-limited activities is known from German Patent Document No. DE 296 20 650 which, in addition, features a display for the visualization of all parameters.

It may be that the safety of persons to be monitored can be increased through the use of such monitoring devices as compared with a purely manually active monitoring person. However, there is the disadvantage that the persons to be monitored are themselves not in communication with the monitoring device and, in addition, cannot be promptly informed about the instantaneous time lapse.

European Patent Document No. 08 01 368 A1 describes a monitoring device which can be used in conjunction with respiratory equipment worn, for example, by fire fighters. In addition to a pressure sensor, this device also contains a motion sensor. An alarm apparatus generates a warning signal when the pressure reaches a critical value, or when no movement of the user is detected any longer. Furthermore, the monitoring device has means for transmitting data from the pressure sensor and the motion sensor, as well as alarm signals, via an infrared connection to an external radio device, which in turn routes the data via a radio link to a manager monitoring the user.

U.S. Pat. No. 5,392,771 discloses a monitoring system for portable respiratory equipment. The monitoring system has a transmitter and a receiver separate therefrom. Both the transmitter and the receiver are carried by the user of the respiratory equipment. The transmitter is allocated, for example, to a pressure sensor and transmits the detected data, for instance, via radio to the receiver. In contrast to the known monitoring system, in which a radio transmission takes place between a transmitter and a receiver which are arranged in the immediate vicinity of the user, the present invention relates to a radio transmission between a mobile device carried by the user and a base station arranged at a distance from the user.

SUMMARY OF THE INVENTION

Consequently, an object of the present invention is to provide a monitoring system, a mobile part and a base station with which it is possible to monitor and protect wearers of respiratory equipment better than before during a mission and, in particular, in an emergency.

An object of the present invention is to create an essentially automatically operating monitoring system which is capable, at each instant of a mission, of informing each team member wearing respiratory equipment and the monitoring person responsible for that team about the condition of his/her respiratory equipment or of all respiratory equipment and which is capable, in an emergency, of triggering an alarm both in the case of the respiratory-equipment wearer who is in distress and in the case of the monitoring person.

The monitoring system has at least one mobile part which is connectable to a compressed-air breathing apparatus that can be fastened, for example, on the back of a wearer. The mobile part is allocated at least one sensor for acquiring predetermined status data, particularly status data of the compressed-air breathing apparatus. Also provided is a base station capable of communicating with the mobile part of each respiratory-equipment wearer via a wireless connection. The base station is advantageously in the form of a mobile apparatus which can be taken to any location by the monitoring person. In order to be able to transmit to the base station the status data which have been acquired by the sensor, the mobile part has a radio transmitting apparatus. Similarly, the base station contains a radio receiving apparatus for receiving the status data transmitted from the mobile part. Both the mobile part and the base station contain a warning and/or alarm apparatus which generates visual and/or audible signals as a function of the acquired status data. The warning and/or alarm apparatus may, for example, be a loudspeaker and light-emitting diodes which can be suitably driven.

To enable those respiratory-equipment wearers currently on mission to be monitored in the base station, provision is made in the mobile part for a central control unit to transmit to the base station a message for logging the respective mobile part on or off at the base station.

To achieve a high degree of safety in the monitoring of the wearers of respiratory equipment, it is possible to connect to the mobile part: a pressure sensor for measuring the pressure of the compressed-air cylinders of the compressed-air breathing apparatus, a temperature sensor for measuring the ambient temperature of the respiratory-equipment wearer, a motion sensor for detecting motions of the respiratory-equipment wearer and/or a sensor for detecting an emergency-call function triggered by the respiratory-equipment wearer. Such an emergency-call function can be triggered, for example, by pulling a handle attached to the carrying strap of the compressed-air breathing apparatus.

The warning and/or alarm apparatus is activated as soon as the respective sensors have detected that a preset threshold value has been undershot or exceeded.

Further provided is an adjustable time-measuring apparatus for measuring the time elapsed since the triggering of the time-measuring apparatus. As a function of the pressure of the compressed-air cylinder, it is also possible, with the aid of the time-measuring apparatus and a central control unit, to calculate the remaining mission time of the respective respiratory-equipment wearer and to communicate this to the wearer of the respiratory equipment.

The central control unit is connected to each sensor, the time-measuring apparatus and the warning and/or alarm apparatus, and assumes the control and monitoring of the mobile part.

Normally, the quantity of air remaining in the compressed-air breathing apparatus is checked by measuring the pressure in the compressed-air cylinder using a pressure gauge, it being necessary for the respiratory-equipment wearer to take a reading of the pressure on the pressure gauge at regular intervals. To save the wearer from having to read off such system data, a speech output apparatus is provided which, in response to the measured status data, is capable of transmitting predetermined messages, particularly the pressure, the temperature as well as warning and alarm messages, in speech form at predetermined time intervals to the wearer of the respiratory equipment.

For this purpose, the mobile part expediently features an interface for the wire-bound and wireless connection of an earpiece or headphone, implemented in the helmet of the respiratory-equipment wearer, to the speech output apparatus.

To be able to monitor the conditions of all logged-on wearers of respiratory equipment at a glance, the base station is provided with a display device capable of displaying the status data of all logged-on mobile parts.

To be able to evaluate and process the acquired status data externally as well, the mobile part is provided with a memory for the temporary storage of the acquired status data and with an interface for the connection of an external computer to which the stored status data can be output.

To enable the measured status data to be transmitted reliably to the base station via a radio channel, first of all, each sensor is allocated an analog/digital converter which converts the analog measured quantities into digital data. Next, the digitized status data are supplied to an encoder which converts the digital status data to be transmitted, for example, into a frequency-doubled bi-phase M format. The base station is provided with a correspondingly designed decoder for decoding the received encoded status data.

The power is supplied to the mobile part and the base station, for example, by NiCd batteries which can be fastened on the back of the respective device by velcro tape.

To prevent the speech output apparatus from being activated unnecessarily often, thereby increasing the power consumption of the mobile part, the control unit is designed in such a way that it compares the instantaneous pressure with the last-measured pressure of the compressed-air cylinder of the compressed-air breathing apparatus and activates the speech output apparatus only if the pressure difference has exceeded a predetermined value.

The present invention also provides a mobile monitoring device is provided for attachment to a compressed-air breathing apparatus of a monitoring system. The mobile monitoring device has a central control apparatus which is connectible to at least one sensor for measuring predetermined status data, particularly status data of a compressed-air breathing apparatus. Further provided is a radio transmitting apparatus for the wireless transmission of the measured status data to a base station; additionally provided is a warning and/or alarm apparatus which generates visual and/or audible signals as a function of the measured status data.

The central control unit is designed for transmitting a message for logging the mobile part on or off at the base station.

In an embodiment of a device according to the present invention, the mobile monitoring device includes a control apparatus to which can be connected a pressure sensor, a temperature sensor, a motion sensor, a sensor for detecting an emergency-call function triggered by the respiratory-equipment wearer and/or an adjustable time-measuring apparatus.

Further provided in the mobile transmission device is an interface for the wire-bound or wireless connection of a headphone to the speech output apparatus, as well as an interface for the connection of an external computer.

The present invention also provides a base station for use in a monitoring system. For this purpose, the base station has a radio receiving apparatus for receiving the status data transmitted from a mobile part attached to a compressed-air breathing apparatus; a warning and/or alarm apparatus which generates visual and/or audible signals as a function of the received status data; and a display device for displaying the status data of each mobile part logged onto the base station.

Using the present invention, vital data from a plurality of respiratory-equipment wearers as well as system status data can be transmitted via a radio connection to a base station and, depending thereon, alarm messages can be triggered both in the case of the monitoring person and in the case of the respiratory-equipment wearers. In this context, it is advantageous that rescue measures can be initiated very much earlier and that human error is largely eliminated, since the data are continuously exchanged.

BRIEF DESCRIPTION OF THE DRAWINGS

Hereinbelow, the present invention is elaborated upon with reference to the drawings, in which.

DETAILED DESCRIPTION

Figure 1:
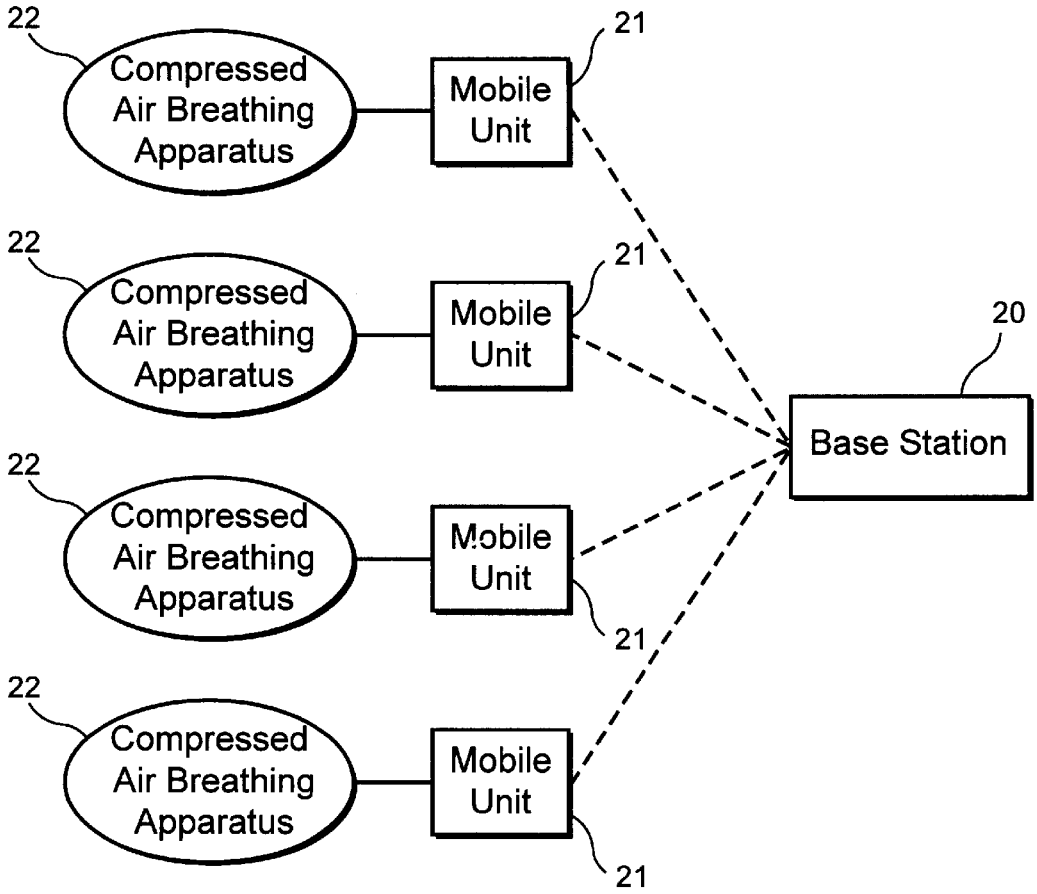
FIG. 1 shows schematically a monitoring system having one base station and four mobile parts.

The monitoring system shown in FIG. 1 includes a base station 20, allocated to a monitoring person, as well as, for example, four mobile parts 21 which are able to communicate with base station 20 via a wireless connection, particularly via a radio channel. Each mobile part 21 is disposed on a compressed-air breathing apparatus 22 which can be strapped to the back of a respiratory-equipment wearer.

In the following, mobile part 21 and base station 20 of the monitoring system are described in detail.

I. Mobile Part 21

Figure 3:
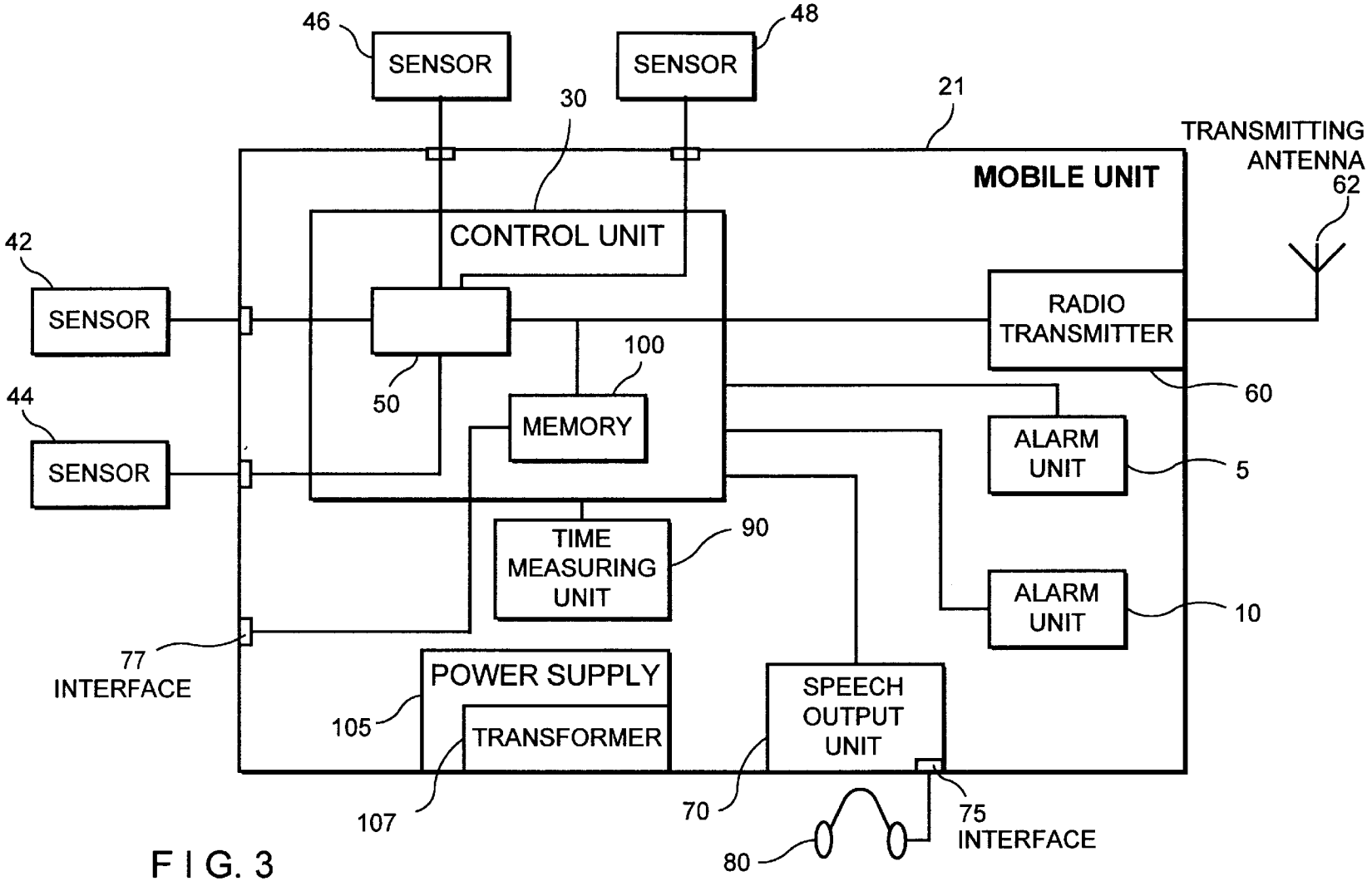
FIG. 3 shows a schematic block diagram of a mobile part.

FIG. 3 shows, in the form of a block diagram, the schematic construction of one of the four mobile parts 21. Mobile part 21 includes, inter alia, the following components: a central control unit 30, in this case a so-called microcontroller with integral real-time clock; a memory 100; an interface 75 for connecting a headphone 80; and an interface 77 for the connection of, for example, an external personal computer. Connected as monitoring sensors to central control unit 30 are a pressure sensor 42, a temperature sensor 48, a motion sensor 44 and a sensor 46 for detecting the triggering of an emergency-call apparatus by the wearer of the respiratory equipment. With the aid of a digital speech output apparatus 70, predetermined announcement texts can be output as normal speech to the respiratory-equipment wearer via connected headphone 80. The system conditions detected by sensors 42, 44, 46 and 48 and supplied to microcontroller 30 can be transmitted to base station 20 via a UHF transmitter 60 and via a transmitting antenna 62. A voltage source 105 supplies mobile part 21 with the required voltage. Voltage source 105, in the form of a battery, can be attached to the outside of the housing of mobile part 21. Since pressure sensor 42 requires a different voltage than the other components, it is supplied with the required DC voltage via a DC voltage converter 107.

As already mentioned, mobile part 21 is attached to a compressed-air breathing apparatus 22 and is electrically connected by connecting cables to external sensors 42, 44, 46 and 48. One connection lead, for example, is routed via the left-hand carrying strap to chest height on the wearer, where it is connected to an emergency-call apparatus, while another lead is routed to headphone 80. Since, in the majority of cases, speed is important in the use of compressed-air breathing apparatus 22, attention has been paid to making user operation as simple as possible. The sequence of the entire process has been automated to such an extent that no control steps whatsoever by the wearer are required. The power supply is so designed that batteries 105 are always kept fully charged in the idle state. For this purpose, batteries 105 are connected to a battery charger. Mobile part 21 itself, however, is not active. When mobile part 21 and thus batteries 105 are removed from the holder containing the battery charger, voltage source 105 is automatically disconnected from the battery charger and mobile part 21 is activated. However, it now remains in the idle state until compressed-air breathing apparatus 22 is set in operation. If central control unit 30 of mobile part 21 then detects that the pressure at sensor 42 has risen to over 180 bar when working with a 200-bar compressed-air cylinder, or to over 270 bar in the case of a 300-bar compressed-air cylinder (minimum pressure which must be present at start of use), it sends an audible message, for example, via speech output apparatus 70 and headphone 80, to the wearer of the respiratory equipment that the unit is ready for operation: "Your apparatus is ready for use." Immediately thereafter, central control unit 30 sends a data telegram via radio transmitter 60 and antenna 62 to base station 20 logging on mobile part 21 as active. Speech output apparatus 70 is used, for example, to announce the instantaneous pressure of compressed-air breathing apparatus 22 and to transmit the instantaneous pressure values to base station 20. Now, a time-measuring apparatus 90 is also started. From this point on, the pressure of compressed-air breathing apparatus 22 allocated to mobile part 21 is measured every 15 seconds. However, in order not to play back the announcement of the instantaneous pressure unnecessarily often, central control unit 30 first compares the instantaneous pressure to the last-measured value, which is stored in a memory 100. Only if the comparison reveals that the pressure has dropped by 10 bar or more is the new pressure value communicated via speech output apparatus 70 and headphone 80 to the respiratory-equipment wearer and transmitted to base station 20. Otherwise the value is simply stored in memory 100, which may be an EEPROM, in mobile part 21 and/or in base station 20 in order to be evaluated later, for example, in a personal computer connected to mobile part 21 via interface 77. Memory 100 has a size of, for example, 256 bytes, which is sufficient for recording the pressure values up to a mission duration of approximately one hour. If the mission time should exceed this value, which is not to be expected, the oldest pressure values are deleted, so that the values from the last hour are always available (rolling-map memory).

For reasons of the memory space available in speech output apparatus 70, the pressure is not announced to the precise measured value in bar, although the measurement by pressure sensor 42 would permit this, but rather the pressure is rounded off to values of 5 or 10. Of course, the precise measured values are always transmitted to base station 20. The measuring cycle is repeated, for example, every 15 seconds until the pressure of compressed-air breathing apparatus 22 has fallen below 60 bar or until the emergency-call apparatus is triggered by the wearer of the respiratory equipment. In the former case, the announcement of the remaining mission time/pressure is additionally supplemented by the spoken warning: "Retreat immediately". If the wearer triggers the emergency-call apparatus before the pressure of compressed-air breathing apparatus 22 has fallen below the threshold value, an audible confirmation is first issued via speech output apparatus 70: "Your emergency call is being transmitted". This process can then no longer be stopped or canceled. Thereupon, control unit 30 of mobile part 21 sends a double data telegram with the emergency call to base station 20 and activates an audible and/or visual signal generator 10, which makes it easier to locate the wearer. Thereafter, the measuring cycle is continued, i.e., at intervals of 15 seconds, the pressure is checked and, if appropriate, announced and transmitted to base station 20. Renewed operation of the emergency-call apparatus does not now lead to any further transmission.

A further safety apparatus is a motion sensor 44, known also as a "dead man's circuit", which reacts to a lack of movement on the part of the wearer of the respiratory equipment. This motion sensor 44 can be installed additionally or on its own. If the wearer of the respiratory equipment does not move for a defined period of time, he/she is informed by an announcement via speech output apparatus 70 that an alarm will soon be triggered. The wearer can acknowledge the announcement by making a movement. In this case, the counting of the time starts anew. If no such acknowledgment is given, the main alarm to locate the wearer is triggered via signal generator 10 and an emergency-call data telegram is transmitted to base station 20. This alarm corresponds to the alarm which is triggered when the emergency-call apparatus is operated.

As long as the pressure of compressed-air breathing apparatus 22 is above 10 bar, the measuring cycle is repeated until voltage source 105 is exhausted. Normally, however, when the mission has been completed, the high-pressure part of the respiratory equipment is vented, so that the pressure drops considerably below 10 bar. Typically, the pressure is 1 bar. In this case, control unit 30 detects that the mission has been completed and sends a logoff message to base station 20. Mobile part 21 now returns again to the idle state and monitors the applied pressure until it again exceeds the above-stated values. The measuring cycle then begins anew. If mobile part 21 is returned to the holder, it is automatically switched off and batteries 105 are charged.

Figure 2:
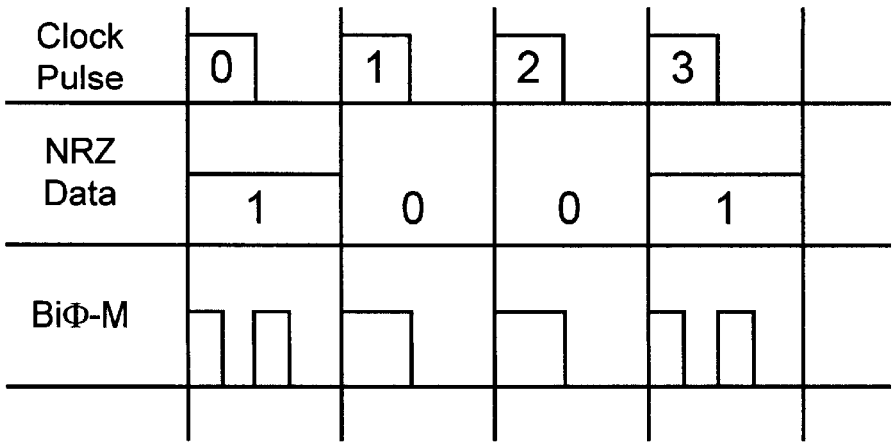
FIG. 2 shows a graphical representation demonstrating the principle of bi-phase M modulation.

A task of mobile part 21 is transmitting the collected data without fault or error to base station 20. However, in order to transmit data via a radio link, they must first be modulated, because it is not possible to transmit a DC-voltage NRZ (Non Return to Zero) signal, such as a binary data stream, without further encoding. The receiver must first be able to regenerate the clock pulse, and secondly to unambiguously differentiate the signal levels (high and low). There are a number of modulation methods which can be employed for FM (frequency modulation) transmission. In the exemplary embodiment described, a frequency-doubled bi-phase M format was selected. In this case, there is a co-phasal state change at the start of each bit cell, so that the receive clock can be unequivocally recovered from the signal. The principle is shown schematically in FIG. 2. This encoding can be performed by an encoder 50 which can already have been implemented in microcontroller 30. In this case, no further discrete circuits are required in mobile part 21.

In the following, the function blocks of mobile part 21 are described in detail. As already mentioned, mobile part 21 is used essentially for recording and transmitting to base station 20 the status data acquired by sensors 42, 44, 46 and 48, as well as for speech output of the pressure, temperature, remaining mission time and warning to retreat. The function blocks described in the following are central control unit 30, voltage supply 105, pressure sensor 42, temperature sensor 48, speech output unit 70 and UHF transmitter 60, as can be seen in FIG. 3.

1. Central Control Unit

Mobile part 21 is controlled, for example, by an 80C535 microcontroller 30 of compact construction. The microcontroller makes available three 8-bit I/O ports, as well as eight 12-bit A/D converters (not shown). A built-in realtime clock ensures correct time information, while a 256-byte EEPROM 100 stores measured data in power-failure-proof manner. Available for external communication is an RS-232 interface 77 which can be used to transmit stored data to a PC or laptop for graphical display and evaluation. In this context, control unit 30 automatically detects whether an interface cable has been connected, and then switches to diagnostic mode. The stored data file can now be retrieved from memory 100 by a PC or the appropriate software, and the memory can be erased for reuse. All the following circuit parts are controlled by this central control unit 30.

2. Voltage Supply

Mobile part 21 has a voltage supply apparatus 105, for example a battery composed of six NiCd cells with a total voltage of 7.2V. This voltage is converted to 5V by a voltage transformer, in order then to serve as supply voltage for central control unit 30. At the same time, it supplies a DC voltage converter 107 of type LT1301 which, when required, generates a voltage of 12V in order to operate air pressure sensor 42. This DC voltage converter 107 functions according to the principle of a charging pump, in that it charges a capacitor in steps with the aid of a coil up to the desired voltage. It achieves an efficiency of approximately 87% in the case of a required output current of 30 mA. The fully charged battery is sufficient for an operating duration of at least 10 hours. It is constantly kept fully charged while on standby.

3. Pressure Sensor

Pressure sensor 42, which measures the instantaneous pressure of compressed-air breathing apparatus 22, must withstand pressures up to at least 300 bar, since compressed-air cylinders with both 200 and 300 bar are used. In the present case, a threaded sensor for pressures up to 400 bar is used, the bursting pressure being above 2400 bar. The connection to the respiratory equipment is via a fast-fill apparatus of the PA94+ compressed-air breathing apparatus which leads directly to the cylinders (high-pressure part). Pressure sensor 42 operates with an operating voltage of 10–30 V; therefore, a DC voltage transformation is necessary, which is carried out in the aforementioned DC voltage converter 107. It supplies a DC voltage, proportional to the applied pressure, in the range of 1–6 volts. This is supplied directly to an A/D converter of microcontroller 30, where it is further processed.

4. Temperature Sensor

The ambient temperature is measured by temperature sensor 48 of type KTY10, which changes its resistance linearly in relation to the prevailing temperature. This sensor 48 is likewise directly connected via a voltage divider to an AID converter of microcontroller 30.

5. Speech Output Apparatus

During the mission, the instantaneous pressure, temperature and anticipated remaining mission time can be regularly announced to the respiratory-equipment wearer by speech output apparatus 70. Additionally, there is an audible warning of a low battery 105 and verbal confirmation that an emergency call has been transmitted. All of these functions are executed, for example, by an IC of type ISD 2560, which, with an 8 kHz sampling rate (equivalent to ISDN telephone quality), is capable of storing speech in analog form for up to 60 seconds. In contrast to the otherwise customary digital storage methods in which the sound information is previously digitized and stored in a RAM memory, this IC uses a relatively new analog storage method. In this context, the instantaneous values are stored directly in analog manner in the form of a charge in a memory cell without making a detour via a converter. This results in a number of decisive advantages over the conventional method: the speech quality is noticeably better with considerably reduced memory requirement, and no voltage is required for maintenance of data. The contents of the speech memory can be directly addressed at 100 ms intervals; thus, it is readily possible to generate speech messages made of combined syllables. This makes it possible to speak individual numbers and text modules into the IC which are then retrieved by microcontroller 30 in the required sequence. Thus, an example of a typical announcement is: "Remaining time 25 minutes; cylinder pressure 180 bar." A battery voltage which is too low is reported with "Caution: low battery level." Readiness for operation is announced by mobile part 21 with "Your apparatus is ready for operation." And the issuing of an emergency call is confirmed with "Your emergency call is being transmitted." The loudspeaker may be a small earphone or a headphone 80 integrated in the helmet.

6. UHF Transmitter

In order to now transmit the data from mobile part 21 to base station 20, it is advantageous to employ a wireless transmission method, such as radio transmission, because all other possibilities (e.g., infrared connection) are ruled out owing to the absence of visual contact and lack of range. In the exemplary embodiment presented, for the frequency selection, the so-called LPD range in the 70 cm band was chosen, in which the frequency of 433.925 MHz used in the exemplary embodiment also lies. There are numerous transmitter and receiver modules on the market for this frequency range which have a general permit and do not therefore need to be licensed by the operator. The transmitting power is limited to 10 mW, which, however, is sufficient for the purposes envisaged in the exemplary embodiment. For professional use, the frequency band might have to be changed and the transmitting power significantly increased to ensure transmission from larger buildings as well. UHF transmitter 60 is produced in miniaturized form and is located on the outside of shielded mobile part 21 in order to prevent HF interference with the circuitry. The modulation input of UHF transmitter 60 is directly connected to an output of microcontroller 30 which generates the data telegram. Antenna 62 may be, for example, a lambda/4 line antenna which, at this frequency, has a length of approximately 17 cm. To keep the power consumption of mobile part 21 as low as possible, UHF transmitter 60 is activated only when needed.

II. Base Station

Figure 4:
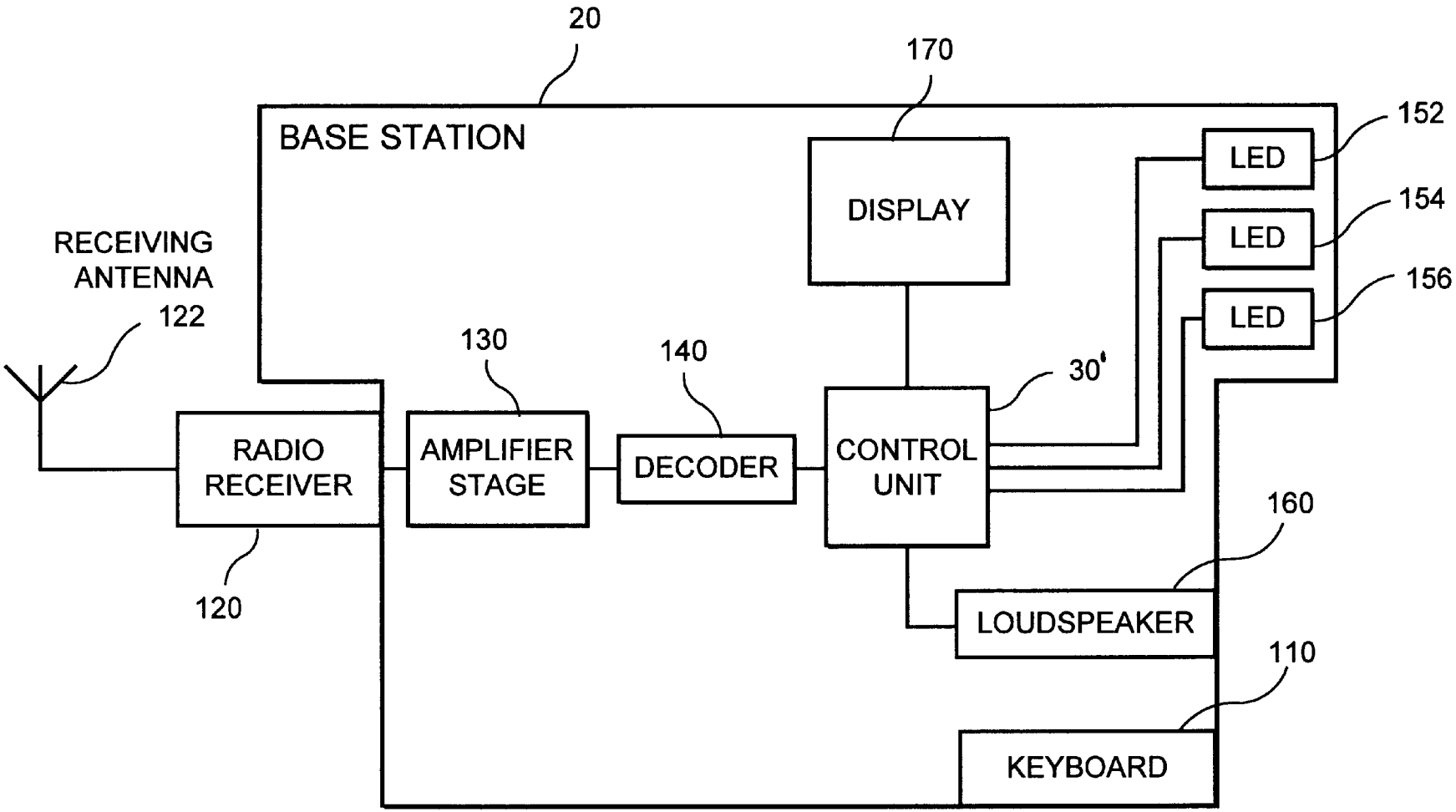
FIG. 4 shows a schematic block diagram of a base station.

FIG. 4 shows, in the form of a block diagram, an exemplary embodiment of base station 20. The entire base station 20 is controlled by a central control unit 30'. An operator is able to enter control commands using a keyboard 110. Messages from the monitoring system are output on a liquid-crystal display 170. Central control unit 30' receives data from each mobile part 21 via a UHF receiver 120 and a decoder 140. For example, seven light-emitting diodes—of which merely three, identified by reference numerals 152, 154 and 156, are shown—are used for the visual display of the operating state. Firstly, there are four red illuminated displays, each of which is allocated to one of the mobile parts 21. They indicate that an emergency call has been triggered. A further red light-emitting diode (LED) signals a low battery voltage in base station 20. The other two green LEDs are used to indicate the strength of the received UHF radio signal and the valid received data. A buzzer 160 is used to provide an audible output of warning and alarm messages. Base station 20 collects the incoming data from mobile parts 21 and displays them on liquid-crystal display 170. To ensure the readability of the information even in darkness or when there is insufficient illumination, display 170 is equipped with background illumination. It operates automatically and is switched on or off depending on the ambient brightness. In addition, it is possible to switch off the illumination generally by pressing a key. Base station 20 is controlled, for example, by keypad 110, which includes 3×4 fields, and which can be made of a self-adhesive membrane keyboard. This keyboard 110 can also be of splashproof design.

Base station 20 is inserted, for example, in a charging holder, e.g., in a vehicle, in which the batteries of base station 20 are constantly kept fully charged. If base station 20 is removed from the charging holder, it is automatically activated and commences a self-test in which display 170, light-emitting diodes 152, 154, 156 and warning buzzer 160 are tested. There is also a check of the battery voltage under load. Once this test, which lasts just a few seconds, has been completed, base station 20 is in standby mode and waits for the data telegram from a mobile part 21. Incoming data are checked for correctness in base station 20 and are then indicated immediately on liquid-crystal display 170. Each of the four mobile parts 21 has on liquid-crystal display 170 a separate display line showing next to each other, for example, the mobile part number, the last-communicated cylinder pressure, the last communicated temperature, the mission time elapsed till now and the anticipated remaining mission time. Possible displays in a status column are "OK" for normal status, "LOW" for reaching of the retreat pressure (<60 bar), "SOS" for a triggered emergency call and "BAT" for low battery voltage. In this context, the "SOS" display has the highest priority and replaces an existing "BAT" or "LOW" display. An incoming emergency call from a mobile part 21 is signaled audibly and visually. The corresponding red warning LED flashes, while buzzer 160 emits an alternating alarm tone. This message must be acknowledged by the user by simultaneously pressing the two "Alarm off" keys on keyboard 1 10. Buzzer 160 stops sounding, but the warning LED remains on until mobile part 21 has been logged off.

If the pressure of a compressed-air breathing apparatus 22 falls below the value of 60 bar, the status of the associated mobile part 21 is changed to "LOW". When a data telegram is received from this mobile part 21, there is additionally a short audible warning tone and the respective line flashes on briefly.

Following is a description of the possible construction of such a base station 20. As shown in FIG. 4, base station 20 is accommodated in a T-shaped housing and can be conveniently carried in one hand. Keyboard 110 is accommodated in the bottom part, while the top part houses liquid-crystal display 170. For reasons of interference immunity, radio receiver 120 may be installed in a separate housing on the back. The batteries are located externally on the back of the device and can be quickly changed without using tools. The function blocks of base station 20 are described in greater detail in the following.

Central Control Unit with Interface

Use is made here of the same microcontroller as in mobile parts 21, but this time it is not in a miniaturized form. However, with 32 kB RAM and 32 kB ROM, the performance data of the 80C535 microcontroller 30' used are the same. Here a real-time clock and an EEPROM are not necessarily built-in. In contrast to control unit 30 of mobile parts 21, however, central control unit 30' of base station 20 assumes significantly more control functions, because, in addition to receiving and decoding the status data from the respective mobile parts 21, central control unit 30' also drives display 170 and scan keyboard 110.

UHF Receiver and Decoder Circuit

The first incoming point for the data telegrams is UHF receiver 120, which may be located in an add-on housing on the back of base station 20. UHF receiver 120 operates as a dual-conversion superhet on a receiving frequency of 433.925 MHz and has a sensitivity of 0.3 $\mu$V (with 12 dB SINAD). At a sufficient receiving level, UHF receiver 120 makes available a switching voltage which informs the following function groups of the presence of data. The received LF signal is passed from the output of receiver 120 to an amplifier stage 130. From there, the amplified signal passes through a decoder 140, such as a pulse- recovery circuit 140, which again generates a data stream with NRZ code from the incoming encoded data signal. Finally, the signal processing terminates at microcontroller 30'.

Power Supply

Power is supplied to base station 20 by eight NiCd mignon batteries (not shown) which are fastened on the back of the device by velcro tape. The voltage of approximately 9.6V directly supplies buzzer 160 and UHF receiver 120, and is regulated down to 5 volts in order to operate microcontroller 30' and display 170. Base station 20 is connected to the battery charger by a socket in the charger, so that it is not necessary to remove the batteries. At the same time, base station 20 is thus always ready for operation. A fully charged battery is sufficient for an operating period of approximately 5–8 hours, depending on whether the illumination is active or not. The charging time is approximately half an hour in the case of a completely discharged battery.

What is claimed is:

1. A monitoring system for monitoring a wearer of respiratory equipment, the monitoring system comprising:

a mobile part connectible to a compressed-air breathing apparatus;

at least one sensor allocated to the mobile part for acquiring status data; and a base station capable of communicating with the mobile part via a wireless connection;

wherein the mobile part includes:

a warning apparatus for generating at least one of visual and audible signals as a function of the acquired status data;

a radio transmitting apparatus for transmitting the acquired status data to the base station; and a central control unit for transmitting a message for logging the mobile part on or off at the base station;

and wherein the base station includes:

a radio receiving apparatus for receiving the status data transmitted from the mobile part; and a second warning apparatus which generates visual and/or audible signals as a function of the received status data.

2. The monitoring system as recited in claim 1 wherein the status data includes status data of the compressed-air breathing apparatus.

3. The monitoring system as recited in claim 1 wherein the at least one sensor includes a pressure sensor for measuring the pressure of the compressed-air breathing apparatus.

4. The monitoring system as recited in claim 1 wherein the at least one sensor includes a temperature sensor for measuring the ambient temperature of the wearer of the respiratory equipment.

5. The monitoring system as recited in claim 1 wherein the at least one sensor includes at least one of a motion sensor for detecting motions of the wearer of the respiratory equipment and a sensor for detecting an emergency-call function triggered by the wearer of the respiratory equipment.

6. The monitoring system as recited in claim 1 wherein the mobile part further includes an adjustable time-measuring apparatus for measuring a time elapsed since a triggering of the time-measuring apparatus.

7. The monitoring system as recited in claim 1 wherein the mobile part further includes an adjustable time-measuring apparatus for measuring a time elapsed since a triggering of the time-measuring apparatus, and wherein the central control unit is connected to each of the at least one sensor, to the time-measuring apparatus and to the warning apparatus.

8. The monitoring system as recited in claim 1 wherein the mobile part further includes a speech output apparatus which, in response to the acquired status data, is capable of transmitting predetermined messages in speech form at predetermined time intervals to the wearer of the respiratory equipment.

9. The monitoring system as recited in claim 8 wherein the predetermined messages include at least one of warning and alarm messages.

10. The monitoring system as recited in claim 1 wherein the mobile part further includes a memory for temporary storage of the acquired status data.

11. The monitoring system as recited in claim 1 wherein the mobile part further includes a speech output apparatus which, in response to the acquired status data, is capable of transmitting predetermined messages in speech form at predetermined time intervals to the wearer of the respiratory equipment, and wherein the mobile part further includes an interface for wire-bound or wireless connection of a headphone to the speech output apparatus and further includes an interface for the connection of an external computer.

12. The monitoring system as recited in claim 1 wherein the mobile part further includes an encoder for encoding the status data to be transmitted, and wherein the base station further includes a corresponding decoder for decoding the received status data.

13. The monitoring system as recited in claim 1 wherein the mobile part further includes a respective analog/digital converter allocated to each of the at least one sensor.

14. The monitoring system as recited in claim 1 wherein the mobile part further includes a speech output apparatus which, in response to the acquired status data, is capable of transmitting predetermined messages in speech form at predetermined time intervals to the wearer of the respiratory equipment, and wherein the mobile part further includes a power supply apparatus for supplying the at least one sensor, the central control unit, the warning apparatus and the speech output apparatus.

15. The monitoring system as recited in claim 1 wherein the mobile part further includes a speech output apparatus which, in response to the acquired status data, is capable of transmitting predetermined messages in speech form at predetermined time intervals to the wearer of the respiratory equipment, and wherein the control unit is capable of comparing an instantaneous pressure with a last-measured pressure of the compressed-air breathing apparatus and activating at least one of the warning apparatus and the speech output apparatus if the pressure difference exceeds a predetermined value.

16. The monitoring system as recited in claim 1 wherein the base station further includes a display device for displaying the status data of the mobile part.

17. A mobile monitoring device for attachment to a compressed-air breathing apparatus of a monitoring system, the monitoring system for monitoring a wearer of respiratory equipment, the monitoring system including a base station, the mobile monitoring device comprising:

a central control apparatus connectible to at least one sensor for acquiring status data;

a warning apparatus for generating at least one of visual and audible signals as a function of the acquired status data;

a radio transmitting apparatus for the wireless transmission of the acquired status data to the base station;

wherein the central control unit is capable of transmitting a message for logging the mobile part on or off at the base station.

18. The mobile monitoring device as recited in claim 17 wherein the status data includes status data of the compressed-air breathing apparatus.

19. The mobile monitoring device as recited in claim 17 further comprising an adjustable time-measuring apparatus for measuring the time elapsed since a triggering of the time-measuring apparatus, wherein the at least one sensor includes a pressure sensor for measuring the pressure of the compressed-air breathing apparatus, a temperature sensor for measuring the ambient temperature of the wearer of the respiratory equipment, and a motion sensor for detecting motions of a wearer of the respiratory equipment, and wherein the control apparatus is connectible to the adjustable time-measuring apparatus and to each of the at least one sensor.

20. The mobile monitoring device as recited in claim 17 further comprising a speech output apparatus which, in response to the measured status data, is capable of transmitting predetermined messages in speech form at predetermined time intervals to the wearer of the respiratory equipment.

21. The mobile monitoring device as recited in claim 20 wherein the predetermined messages include at least one of warning and alarm messages.

22. The mobile monitoring device as recited in claim 17 further comprising an interface for the connection of an external computer, further comprising a speech output apparatus which, in response to the measured status data, is capable of transmitting predetermined messages in speech form at predetermined time intervals to the wearer of the respiratory equipment, and further comprising an interface for wire-bound or wireless connection of a headphone to the speech output apparatus.

23. A base station for use in a monitoring system, the monitoring system for monitoring a wearer of respiratory equipment, the monitoring system including a mobile monitoring device attached to a compressed-air breathing apparatus, the mobile monitoring device including a central control apparatus connectible to at least one sensor for acquiring status data and capable of transmitting a message for logging the mobile part on or off at the base station, a warning apparatus for generating at least one of visual and audible signals as a function of the acquired status data, and a radio transmitting apparatus for the wireless transmission of the acquired status data to a base station, the base station comprising:

a radio receiving apparatus for receiving the status data transmitted from the mobile part;

a second warning apparatus for generating visual and/or audible signals as a function of the received status data; and a display device for displaying the status data of the mobile part.

* * * * *